United States Patent [19]

Burk et al.

[11] Patent Number: 4,693,095

[45] Date of Patent: Sep. 15, 1987

[54] CLOTHES MOVER AGITATOR FOR AUTOMATIC WASHER

[75] Inventors: Jeffrey L. Burk, Lincoln Township, Berrien County; Michael J. Bottas, St. Joseph Township, Berrien County; John W. Pielemeier, St. Joseph; Dale E. Mueller, Benton Township, Berrien County, all of Mich.

[73] Assignee: Whirlpool Corporation, Benton Harbor, Mich.

[21] Appl. No.: 941,741

[22] Filed: Dec. 15, 1986

[51] Int. Cl.[4] ..... D06F 17/10

[52] U.S. Cl. ..... 68/134

[58] Field of Search ..... 68/133, 134

[56] References Cited

U.S. PATENT DOCUMENTS 4,137,736 2/1979 Platt et al. ..... 68/134

4,452,054 6/1984 Hafstrom ..... 68/134 X

FOREIGN PATENT DOCUMENTS 209384 11/1984 Japan ..... 68/134

*Primary Examiner*—Philip R. Coe

*Attorney, Agent, or Firm*—Hill, Van Santen, Steadman & Simpson

[57] ABSTRACT

In a dual action agitator for use in an automatic clothes washer, a barrel-shaped upper agitator includes a plurality of fins of different lengths and each having curved blade portions at the lower end thereof. The blade portions of adjacent fins form an interrupted screw thread to enhance vertical movement of a clothes lead adjacent the agitator for improved clothes rollover.

10 Claims, 7 Drawing Figures

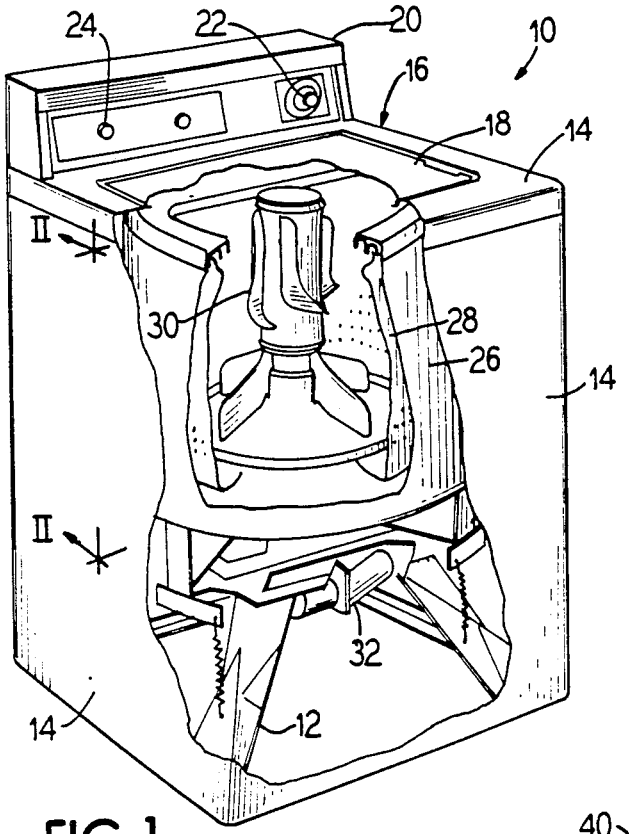
FIG. 1
FIG. 5
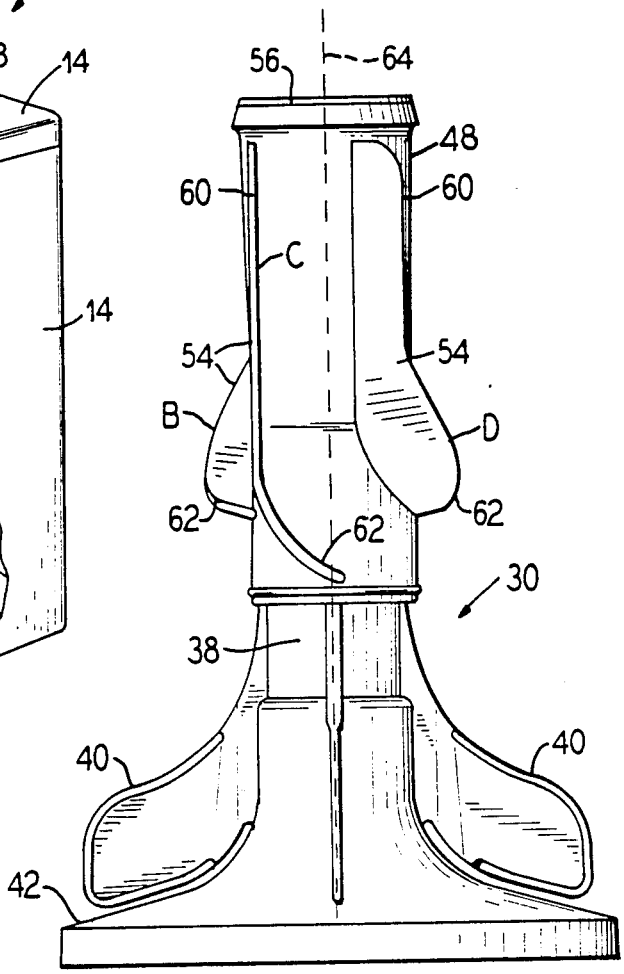
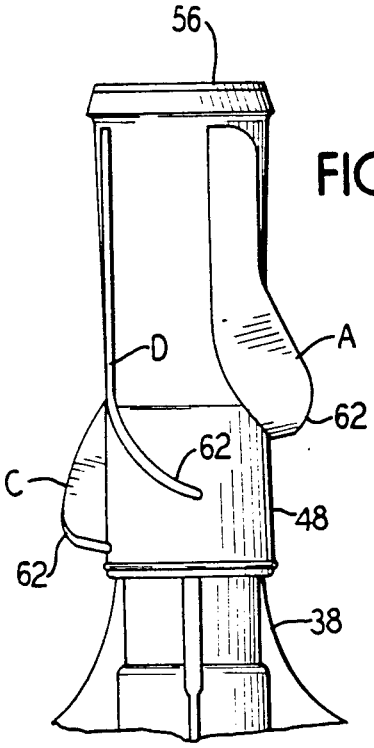
FIG. 6
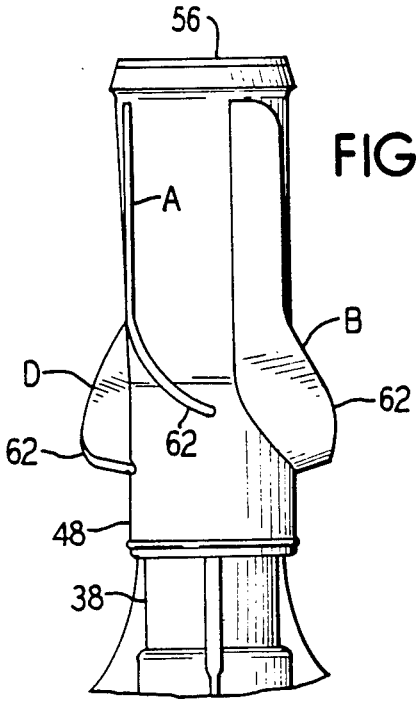
FIG. 7

CLOTHES MOVER AGITATOR FOR AUTOMATIC WASHER

BACKGROUND OF THE INVENTION

1. Field of the Invention

The present invention relates to an automatic washer and, more particularly, to a dual action agitator for use in an automatic washer.

2. Description of the Prior Art

In washing machines having vertical axis agitators, improved washing action is achieved when there is rollover of the wash load within the washer so that each of the articles being laundered is moved near to the agitator at some time during the wash cycle. As used herein, "rollover" is defined as rotation about a toroid, movement being generally vertical at an outside of the toroid and generally vertical in an opposite direction at an inside of the toroid.

A variety of single action and dual action agitators have been proposed to increase wash load rollover. The single action agitators generally have spiral or helical vanes to move the wash load. In the known dual action agitators, an upper portion of the agitator moves independently of a lower portion of the agitator so that the upper agitator portion drives clothes downwardly at the center of the wash chamber to the lower agitator portion.

SUMMARY OF THE INVENTION

Improved rollover of a wash load in an automatic washer is provided by an agitator according to the principles of the present invention, wherein the agitator includes an upper agitator portion for rotational movement in one direction, the upper agitator portion having tangentially extending vanes to generate an extended rollover path toward a lower agitator portion on which the upper agitator is mounted. The cylindrical upper agitator portion rotates intermittently in one direction as the lower agitator portion oscillates rotationally. The tangentially extending vanes on the upper agitator have a general reverse-J configuration with an upper end extending substantially parallel to the axis of the upper agitator portion. A lower end of the vanes is curved along the cylindrical surface of the upper agitator portion. The curved lower ends of respective ones of the tangential vanes are staggered vertically about the upper agitator portion to form an interrupted helical vane. As the upper agitator portion rotates, the curved lower ends drive the articles to be laundered downward at the center of the wash tub to the oscillating lower agitator blades resulting in improved wash action. The reverse J-shaped vanes provide a longer rollover path for improved rollover action of the wash load.

In one embodiment of the present invention, four tangentially directed blades, or vanes, are provided extending from the upper agitator portion. A first one of the vanes is shorter, two of the vanes are of intermediate length, and a fourth one of the vanes is longer than the other vanes. The curved lower ends of three of the four vanes form an interrupted helical thread extending around approximately 270° of the cylindrical upper agitator portion. The remaining vane, which is of intermediate length, lies opposite the other intermediate length vane.

The lower curved ends of each of the vanes extends further from the surface of the cylindrical upper agitator portion than the upper ends of the vanes. In this way, a vertical force is generated at the bottom of each tangential vane during rotation of the upper agitator barrel. This downward force moves articles to be washed from the top of the wash load toward the oscillating lower agitator blades so that the entire wash load becomes cleaner.

BRIEF DESCRIPTION OF THE DRAWINGS

FIG. 1 is a perspective view of an automatic washer, partially cut away, including a dual action agitator according to the principles of the present invention.

FIG. 5 is an elevational view of the dual action agitator of the present invention.

FIG. 6 is a partial elevational view of the barrel of the present dual action agitator generally from the right with respect to FIG. 5.

FIG. 7 is a partial elevational view of the barrel of the present agitator generally from the left with respect to FIG. 5.

DESCRIPTION OF THE PREFERRED EMBODIMENTS

Figure 2:
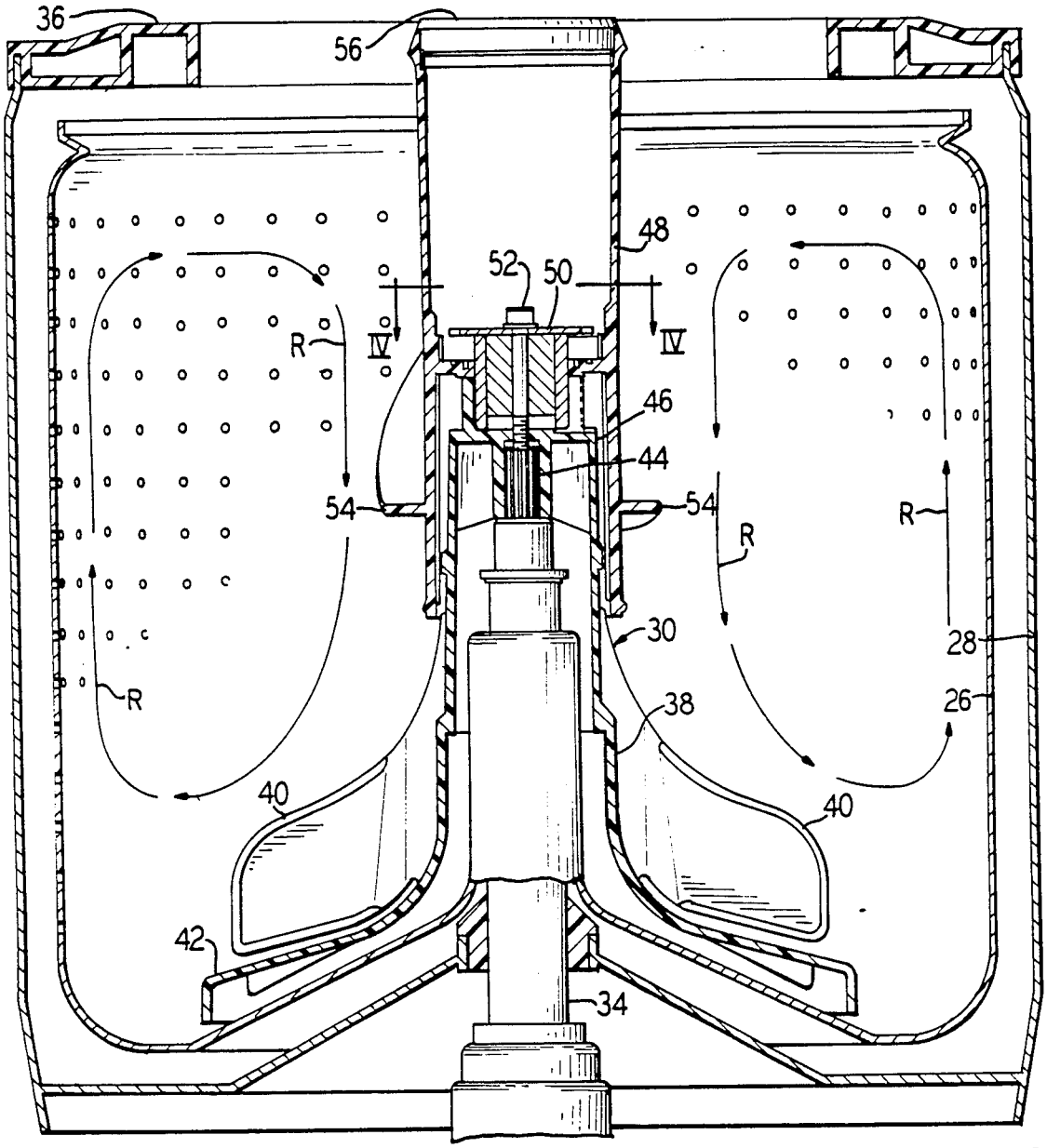
FIG. 2 is a cross section taken generally along the line II—II of FIG. 1 showing an imperforate tub and perforate basket with the present dual action agitator mounted therewithin.

In FIG. 1, reference numeral 10 indicates generally a vertical axis agitator type washing machine having presettable controls for automatically operating the machine through a programmed series of washing, rinsing, and spinning steps. The machine includes a frame 12, carrying panels 14 forming the sides, top, and back of a cabinet 16, a hinged lid 18 is provided in the usual manner for access to the interior of the washing machine 10. The washing machine 10 has a rear console 20 in which is disposed manually settable control means, including a timer dial 22 and a temperature selector 24.

Internally of the washing machine 10 there is disclosed an imperforate fluid containing tub 26 within which is rotatably mounted a perforate basket 28 for rotation about a vertical axis. A vertically disposed agitator 30 is connected for operation to a motor 32.

Referring to FIG. 2, the agitator 30 is mounted on a vertical shaft 34 driven by the motor 32, which shaft 34 extends upwardly through the perforate basket 28 and the imperforate tub 26. A tub ring 36 extends around the top of the tub 26. The agitator 30 includes a lower agitator portion 38 having radially extending blades 40 disposed above a flared skirt 42. The lower agitator 38 is mounted on a splined fitting 44 for rotation with the drive shaft 34, the splined fitting 44 being within a cylindrical upper portion 46 of the lower agitator 38. Although the present invention is disclosed in conjunction with a lower agitator 38 having radially extending blades 40, it can be used with a variety of other lower agitator types.

A barrel-shaped upper agitator 48 is mounted over the portion 46 of the lower agitator 38. The upper agitator 48 is independently movable with respect to the lower agitator 38 and is driven by a one-way clutch 50 linked by a vertically extending bolt 52 to the drive shaft 34. The clutch 50 drives the barrel-shaped upper agitator 48 intermittently in a single direction as the lower agitator 38 oscillates. A plurality of vanes or fins 54 extend from the barrel-shaped upper agitator 48 for added wash action as the agitator 38 is driven by the motor 32. A cap 56 is provided over the top of the upper agitator 48 to prevent water and detergent from interfering with the operation of the clutch 50. Flow lines R are shown in FIG. 2 to indicate the rollover direction of a wash load as a result of the present invention.

Figure 3:
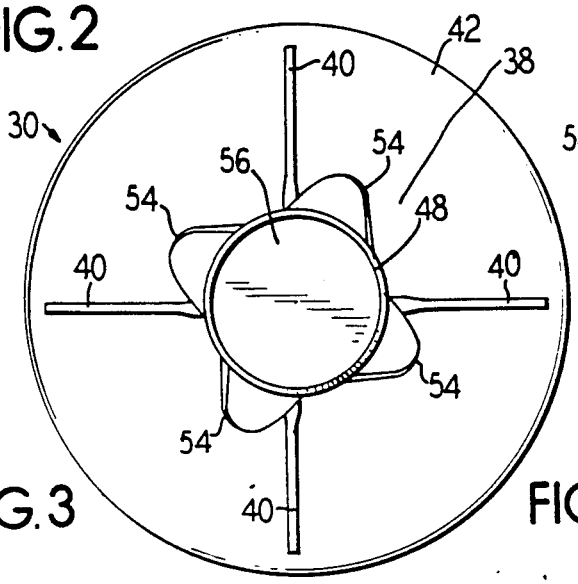
FIG. 3 is a plan view of the present agitator.

In the top view of FIG. 3, the circular skirt 42 of the lower agitator 38 is shown having four of the radially extending vanes 40 spaced equally about the lower agitator 38. Four of the fins 54 extend from the upper agitator barrel 48 and are likewise spaced equally about the circumference of the barrel 48.

Figure 4:
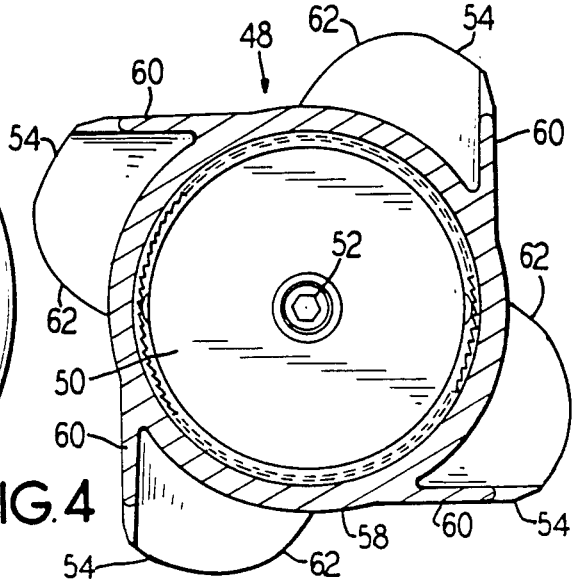
FIG. 4 is a cross section along the line IV—IV of FIG. 2.

As shown in the cross section of FIG. 4, the upper agitator 48 includes a hollow cylindrical body 58 from which the fins 54 extend. Each fin 54 has a tangential element 60 extending from the body 58 and a blade 62 curving about an arcuate portion of the cylindrical body 58. The tangential upper end 60 aids the operation of the unidirectional clutch 50 by impeding reverse motion of the upper agitator 48. The blade 62 extends further from the surface of the cylindrical body 58 than does the tangential segment 60. Therefore, the blade 62 has a greater effect on the wash water and wash load as the barrel 48 rotates than the tangential segment 60. Referring to FIG. 5, the barrel-shaped upper agitator 48 sits atop the lower agitator 38 for rotation about a vertical axis 64 that extends through the center of the upper agitator 48. Each of the fins 54 has the tangential segment 60 thereof extending substantially parallel to the vertical axis 64 of the agitator 30, while the blade 62 of each fin 54 forms a curved surface at the lower end of the fin 54. Thus, each fin 54 defines a reverse J on the surface of the upper agitator 48. For operation of the upper agitator 48 in an opposite direction, each fin 54 would be curved in the opposite direction to form a J configuration.

The fins or vanes 54 are of different lengths, as can be seen with reference to FIGS. 5, 6 and 7. The shortest fin 54, as shown in FIGS. 6 and 7, is identified as fin A, an intermediate length fin 54 adjacent thereto as fin B, the longest fin 54 as fin C, and a second intermediate length fin 54 opposite fin B is fin D. The fins A, B, C and D each have the tangential upper segment 60 extending substantially parallel to the rotational axis 64 of the agitator 30 so that as the upper agitator 48 rotates, additional washing action is imparted to the wash load. The curved blades 62 at the lower end of each of the fins A, B, C and D generate a vertical component in the wash motion as the upper agitator 48 rotates clockwise with respect to FIG. 4. This vertical component has a significant effect on the motion of the wash load, particuarly since the blades 62 extend from the surface 58 further than the segment 60. Thus, the blade portion 62 of each of the fins A, B, C and D acts to drive the wash load downwardly toward the oscillating blades 40 of the lower agitator 38. This downward motion caused by the upper agitator 48 increases rollover of the wash load, the rollover occurring as shown in FIG. 2. The various length fins A, B, C and D help to create a longer rollover path for more efficient movement of the wash load.

In the illustrated embodiment, the blade portions 62 of the fins A, B, C and D form an interrupted or non-continuous screw thread to assist in rollover. The Applicants have determined that it is advantageous to have a second intermediate length fin D to impart added vertical force and to close the large vertical gap between fins A and C on the opposite side of fin B. The fin D also provides a balancing effect by balancing the effects of the other fins.

The present dual action agitator 30 acts as a vertical clothes mover and has smooth surfaces to prevent snagging of the articles being laundered. The staggered fins A, B, C and D of the present invention, by forming a non-continuous or broken thread or helix, causes improved rollover for better wash action in a wash load. Although the present clothes mover agitator is disclosed as having independently movable upper and lower agitators, the use of a single action agitator having the disclosed vane arrangement is also contempated by the present invention.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution.

The embodiments of the invention in which an exclusive property or privilege is claimed are defined as follows:

1. An agitator for use in a wash tub of an automatic washer including a drive motor to rotationally oscillate the agitator within the wash tub to agitate a wash load, comprising:

an agitator body connected for rotational movement by the drive motor about an axis, said agitator body having upper and lower portions, said upper portion having a generally cylindrical surface;

a plurality of blades extending from said lower portion of said agitator body at least a first distance, said plurality of blades agitating the wash load during rotational oscillation of said agitator body; and a plurality of vanes extending from said upper portion of said agitator body less than said first distance, each of said vanes having an upper end extending substantially parallel to said axis of said agitator body, said upper end being tangential to said cylindrical surface, each of said vanes having a lower end curving about an arc of said cylindrical surface, said curved lower ends of adjacent ones of said vanes disposed at mutually different radial and longitudinal locations with respect to said axis, said lower curved ends extending further from said cylindrical surface than said upper ends of said vanes, said plurality of vanes being separate from said plurality of blades.

2. An agitator as claimed in claim 1, wherein said plurality of vanes and said plurality of blades are equal in number.

3. An agitator as claimed in claim 1, wherein said curved lower ends of adjacent ones of said vanes form an interrupted helix.

4. An agitator as claimed in claim 1, wherein said upper and lower portions of said agitator body are independently movable.

5. An agitator as claimed in claim 1, wherein said lower portion of said agitator body has five radially extending blades.

6. A dual action agitator for use in an automatic washer having a wash tub for holding articles to be washed and a motor and drive means for driving said agitator in rotational oscillatory motion, comprising:

an agitator base rotationally mounted in said wash tub, said agitator base having an outwardly directed lower flange and a plurality of outwardly extending agitator blades, said agitator base having an upper portion extending above said agitator blades;

a generally cylindrical upper agitator barrel extending partially over said upper portion of said agitator base;

means between said agitator base and said upper agitator barrel for unidirectionally driving said upper agitator barrel when said agitator base is rotationally oscillated;

a plurality of vanes extending from said cylindrical upper agitator barrel, each of said vanes having an upper end extending substantially parallel to a rotational axis of said cylindrical upper agitator barrel, said vanes each having a lower end forming a curve about an arc on the surface of said upper agitator barrel, ones of said plurality of lower vane ends being disposed at different radial and longitudinal locations with respect to the rotational axis, so that said lower vane ends extending outward from the surface of said upper agitator barrel a greater distance than said upper vane ends;

whereby, said vanes engage articles in a wash load and cause such articles to rotate toroidally within said wash tub.

7. A dual action agitator as claimed in claim 6, wherein said lower ends of adjacent ones of said vanes form a broken helix.

8. A dual action agitator as claimed in claim 6, wherein said lower vane ends of ones of said vanes are staggered along the surface of said upper agitator to form an interrupted screw thread over about 270° of the cylindrical upper agitator barrel.

9. A dual action agitator as claimed in claim 6, wherein four of said vanes are provided on said upper agitator.

10. A dual action agitator as claimed in claim 9, wherein two of said four vanes are of substantially the same length, a third one of said vanes is longer than said two same length vanes, and a fourth one of said vanes is shorter than said two same length vanes, said two same length vanes being disposed substantially diametrically opposite one another on said upper agitator barrel, said shorter and longer vanes being disposed substantially diametrically opposite one another on said agitator barrel and midway between said two same length vanes.

* * * * *